US005317957A

United States Patent [19]

Miyamoto

[11] Patent Number: 5,317,957

[45] Date of Patent: Jun. 7, 1994

[54] RODLESS CYLINDER WITH IMPROVED SEALING BELT

[75] Inventor: Michikazu Miyamoto, Yawara, Japan

[73] Assignee: SMC Corporation, Tokyo, Japan

[21] Appl. No.: 941,221

[22] Filed: Sep. 4, 1992

[30] Foreign Application Priority Data

Sep. 6, 1991 [JP] Japan ..... 3-254483

[51] Int. Cl.[5] ..... F01B 29/00

[52] U.S. Cl. ..... 92/88; 277/DIG. 7

[58] Field of Search ..... 92/88; 277/DIG. 7

[56] References Cited

U.S. PATENT DOCUMENTS

| | | | |
|---|---|---|---|
| 4,545,290 | 10/1985 | Lieberman | 92/88 |
| 4,664,019 | 5/1987 | Lipinski et al. | 92/88 |
| 4,664,020 | 5/1987 | Kaiser | 277/DIG. 7 X |
| 4,733,604 | 3/1988 | Lipinski | 92/88 |
| 4,829,881 | 5/1989 | Taki et al. | 277/DIG. 7 X |
| 4,991,494 | 2/1991 | Migliori | 277/DIG. 7 X |

FOREIGN PATENT DOCUMENTS 60-237208 11/1985 Japan .

*Primary Examiner*—Edward K. Look
*Assistant Examiner*—John Ryznic
*Attorney, Agent, or Firm*—Oblon, Spivak, McClelland, Maier & Neustadt

[57] ABSTRACT

A rodless cylinder prevents leakage of fluid through a sealing belt and thus increases the freedom in the design of the edge of its seal lip. The rodless cylinder has a piston and a driven table reciprocating over a cylinder which are connected by a piston yoke through a slit extending along a cylinder bore. A sealing belt to seal the slit in the cylinder has a sealing lip which comes in contact with the wall of the cylinder bore at each end of the inner wall that constitutes a part of the wall of the cylinder bore, a sealing projection near the edge of the sealing lip whose edge comes in contact with the inner wall of the slit, and another seal projection that comes in contact with a sealing seat projecting from the inner wall of the slit.

3 Claims, 3 Drawing Sheets

RODLESS CYLINDER WITH IMPROVED SEALING BELT

FIELD OF THE INVENTION

This invention relates to a rodless hydraulic cylinder for use in the driving of machines, transportation of goods and other applications. More particularly, this invention relates to a rodless cylinder that increases the tightness of the seal applied to a slit extending along the cylinder bore through which the piston and the driven table are mechanically connected.

DESCRIPTION OF THE PRIOR ART

Rodless cylinders comprising a cylinder proper, a piston hydraulically reciprocated through the cylinder bore and a driven table directly connected to the piston and reciprocating over the cylinder proper, with the piston and driven table mechanically connected through a slit extending along the cylinder bore have been proposed in, for example, Japanese Provisional Patent Publication No. 237208 of 1985.

In the rodless cylinder of this type, the slit through which the piston yoke to mechanically connect the piston and the driven table passes must be sealed with a sealing belt, with the exception of the area in which the piston yoke moves. FIG. 5 shows an example of the cross-sectional shape of the seal belt.

A sealing belt 108 shown in FIG. 5 hermetically seals a slit 106 in a cylinder proper 101. A sealing belt proper 109 has an inner wall surface 110 that constitutes a part of the inner wall of a cylinder bore 102 inside the slit 106, a seal lip 111 at each end of the inner wall surface that comes in contact with an inclined surface 107 on each side of the slit 106 facing the cylinder bore 102, a seal projection 114 that comes in contact with a seal seat 116 projecting from the inner wall of the slit 106 in the cylinder proper 101 and another seal projection 115 that comes in contact with an upper shoulder 117 of the seal seat 116 when hydraulic pressure is supplied into the cylinder bore.

Improving the tightness of the seal belt 108 presents some problems as described below.

To increase the tightness of the contact of the seal lip 111 with the inclined surface 107 on the wall of the cylinder bore 102 and reduce the level difference between the edge of the seal lip 111 and the wall surface of the cylinder bore, the thickness of the edge of the seal lip 111 must be reduced to a minimum. However, this thickness reduction sometimes impairs the dimensional accuracy and uniformity in the longitudinal direction of the seal lip 111. Then, the edge of the seal lip 111 becomes wavy as shown in FIG. 6 so as to break the nonleaking sealing.

The hydraulic fluid does not flow out directly because the seal projection 114 of the seal belt 108 is tightly pressed against the seal seat 116 of the cylinder proper 101. However, it flows in the direction of the stroke of the piston in the cylinder proper 101 through a space 113 left between the inner wall of the slit 106 in the cylinder proper 101 and the seal belt 108 between the seal lip 111 and the seal projection 114, and then leaks outside from an end cover at each end of the cylinder proper 101. Though the leakage may be prevented if appropriate preventive measure is taken at the end cover, the seal belt 108 has such an intricate cross-sectional shape that a perfectly tight seal is difficult to provide at the end cover.

SUMMARY OF THE INVENTION

An object of this invention is to provide a rodless cylinder that prevents leakage of the hydraulic fluid due to deformation of the seal lip.

Another object of this invention is to provide a rodless cylinder that prevents leakage of the hydraulic fluid by a simple measure to provide an integral seal projection near the seal lip.

Still another object of this invention is to provide a rodless cylinder that prevents deformation of the edge of the seal lip by reinforcing the same with the seal projection, thus increasing design freedom of the edge of the seal lip.

Yet another object of this invention is to provide a rodless cylinder that prevents leakage of the hydraulic fluid to the exterior even when leakage occurs at the seal lip by means of a seal belt of such a cross-sectional shape as can readily seal the leaking fluid at the end cover.

To achieve the above objects, a rodless cylinder according to this invention essentially comprises, like the rodless cylinder disclosed in Japanese Provisional Patent Publication No. 237208 of 1985, a cylinder proper, a piston hydraulically reciprocated through the cylinder bore and a driven table directly connected to the piston and reciprocating over the cylinder proper, with the piston and driven table mechanically connected by a piston yoke through a slit extending along the cylinder bore.

In the rodless cylinder of this invention, the seal belt that seals the slit in the cylinder proper, with the exception of the area in which the piston yoke moves, has a seal lip coming into contact with the wall of the cylinder bore at each end of the inner wall thereof that constitutes a part of the cylinder bore wall, a seal projection whose edge seals the slit by coming in contact with the inner wall thereof when hydraulic pressure is supplied into the cylinder bore, and another seal projection that comes in contact with a seal seat provided on the inner wall of the slit when hydraulic pressure is supplied into the cylinder bore.

In the rodless cylinder described above, hydraulic fluid supplied to a pressure chamber on one side of the piston moves the driven table together with the piston. In the first place, the seal belt does not allow leakage of the fluid through the slit. Even when any leakage results from the deformation of the seal lip or due to other causes, the seal projection provided near the edge of the seal lip to come into contact with the inner wall of the slit in the cylinder proper confines the leaked fluid in a small space between the seal lip and seal projection.

The leaked hydraulic fluid flows through the space between the seal lip and seal projection in the direction of the piston stroke. However, the cross-sectional area of the space is small enough to be readily sealed by means of a sealing member provided at the end cover. Therefore, the leakage of hydraulic fluid which occurred at the seal lip can be readily stopped at the end cover.

The integral seal projection provided near the seal lip not only readily stops leakage of hydraulic fluid but also reinforces and prevents the deformation of the edge of the seal lip. Besides, the provision of the seal projection allows some leakage at the seal lip, which, in turn, eliminates the need to take great precautions against fluid leakage and allows greater freedom in the design of the seal lip.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
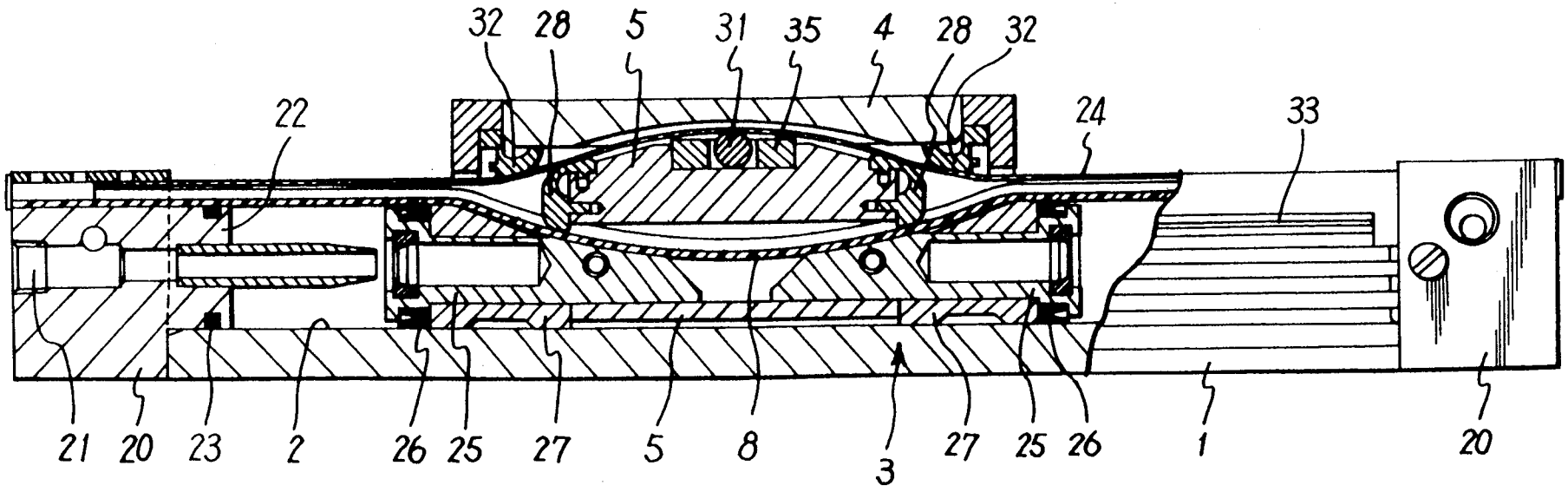
FIG. 1 is a longitudinal cross-sectional view showing principal parts of a rodless cylinder according to this invention.
Figure 2:
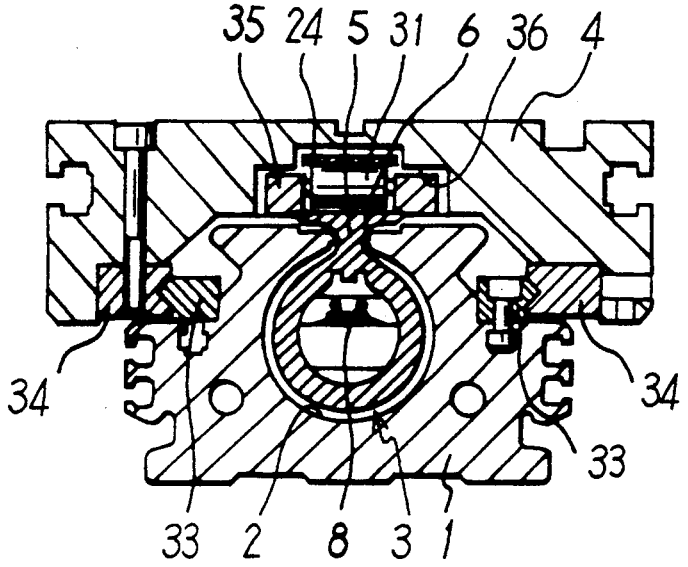
FIG. 2 is a transverse cross-sectional view of the rodless cylinder.

FIGS. 1 to 4 show a rodless cylinder according to this invention. As is obvious from FIGS. 1 and 2, this rodless cylinder comprises a cylinder proper 1, a piston 3 that reciprocates in a cylinder bore 2 in the cylinder proper 1, and a driven table 4 that is directly connected to the piston and reciprocates over the cylinder proper 1. The piston 3 and the driven table 4 are mechanically connected by a piston yoke 5 through a slit 6 that extends along the cylinder bore 2.

Figure 3:
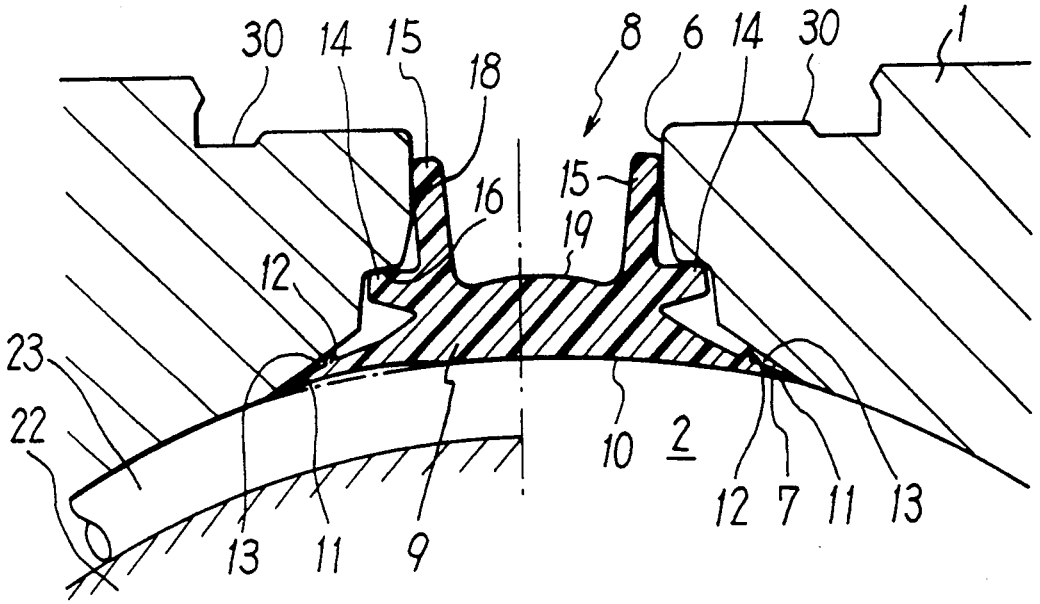
FIG. 3 is an enlarged cross-sectional view of the seal belt of the rodless cylinder.

The slit 6 through which the cylinder bore 2 in the cylinder proper 1 opens upward must be sealed by means of a sealing belt 8 of rubber or synthetic resin, with the exception of the area in which the piston yoke 5 moves. FIG. 3 shows the cross-sectional shape of the sealing belt 8.

The sealing belt 8 shown in FIG. 3 comprises a belt proper 9, an arched inner wall 10 constituting a part of the wall of the cylinder bore 2 in the slit 6, a sealing lip 11 provided at each edge of the inner wall 10 to come in contact with an outwardly inclined surface 7 on each side of the slit 6 facing the cylinder bore 2, and a seal projection 12 provided near the edge of the sealing lip 11, with the edge of the seal projection being adapted to come into contact with the inclined surface 7 of the slit in the cylinder proper 1 when hydraulic pressure works in the cylinder bore. As such, the cross-sectional area of a space 13 left between the inclined surface 7, the edge of the sealing lip 11 and the seal projection 12 is extremely small. Also provided is a seal projection 14 that comes in contact with a seal seat 16 projecting from the inner wall of the slit 6 when the inner wall 10 of the seal belt 8 and the cylinder bore 2 form a round bore as shown in FIG. 3. The seal belt 8 also has a pair of guides 15 guided by the inner surface 18 of the slit 6 above each seal seat 16, and a groove 19 is formed between the guides 15.

An end cover 20 having a port 21 for the flow in and out of hydraulic fluid is fastened to each end of the cylinder proper 1 as shown in FIG. 1. The end cover 20 has a projection 22 that fits in the cylinder bore 2, with an elastic sealing material 23 provided around the projection 22 hermetically sealing the end of the cylinder bore 2. The elastic sealing material 23 also closes the end of the space 13 by pressing a part of the sealing belt 8 close to the edge of the sealing lip 11 against the inclined surface 7 on each side of the slit 6 as shown in FIG. 3. Though it is possible to seal the space 13 by taking advantage of the elasticity of the elastic sealing material 23, without requiring any special sealing means, the space 13 may also be sealed by filling a small quantity of sealing material therein. Anyway, the ends of the space 13 can be sealed easily. The end cover 20 also fastens the end of a dust sealing band 24 covering the top of the slit 6 together with the seal belt 8, as will be described later.

Figure 4:
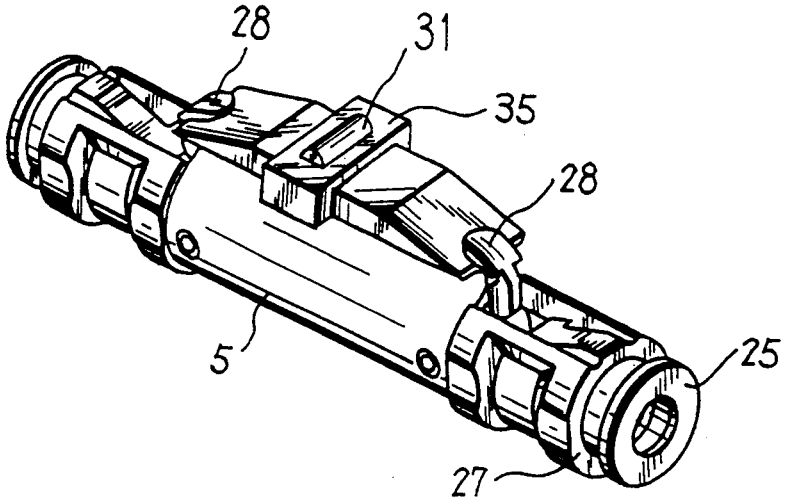
FIG. 4 is a perspective view of the piston and piston yoke of the rodless cylinder.
Figure 5:
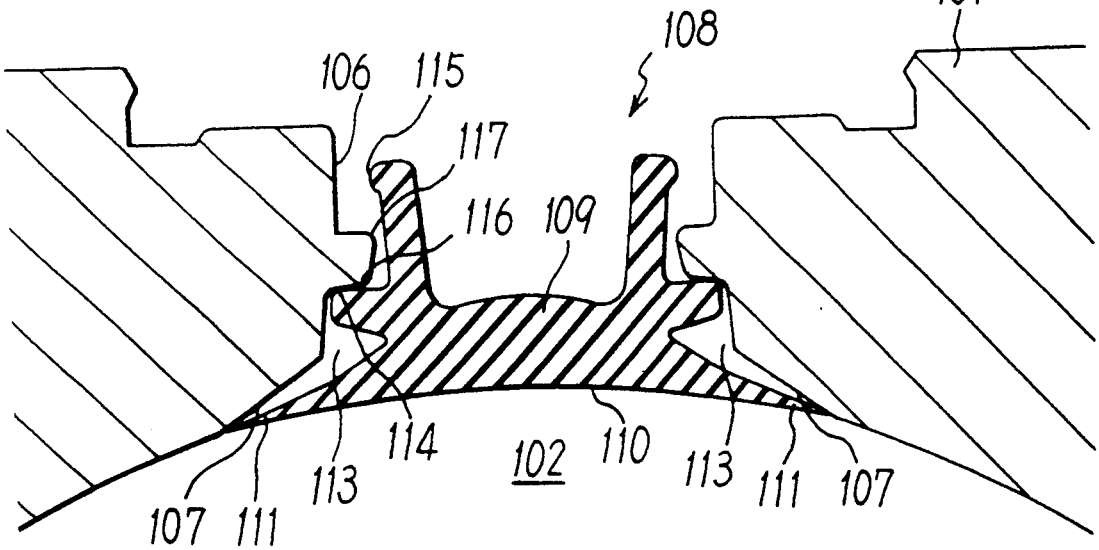
FIG. 5 (PRIOR ART)
FIG. 5 is an enlarged cross-sectional view of a conventional seal belt.
Figure 6:
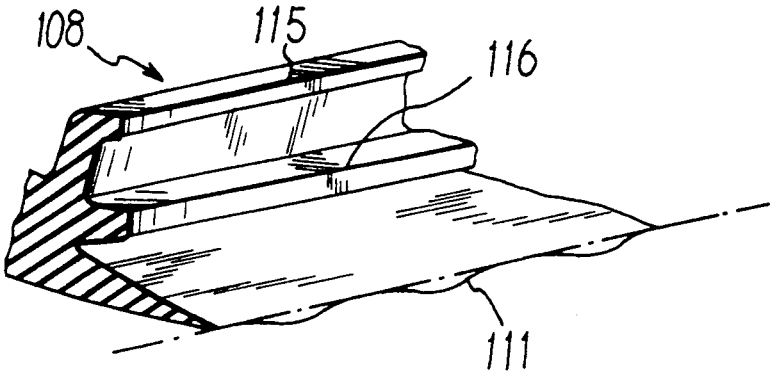
FIG. 6 (PRIOR ART)
FIG. 6 is a perspective view showing a part of a deformed conventional seal belt.

As is obvious from FIGS. 1 and 4, the piston 3 is made up of a pair of piston members 25 disposed at both ends of the driven table 4, with a groove holding a piston packing 26 to seal a space left between the piston member and the wall of the cylinder bore 2 being provided therearound, a wear ring 27 fitted over each piston member 25, and the piston yoke 5 connecting together the pair of piston members 25. A space to pass the sealing belt 8 is formed between the piston members 25 and the piston yoke 5.

The wear ring 27 on the piston 3 carries a piston packing 26 whose end presses the sealing belt 8 toward the slit 6, thereby sealing the pressure chamber between the piston member 25 and the end cover 20. Between the pair of piston members 25, however, the piston 3 can move freely through the space between each piston member 25 and the piston yoke 5.

A belt separator 28 of synthetic resin with low sliding resistance to guide the sealing belt 8 is fitted in the groove 19 in the top surface of the seal belt 8 at each upper end of the piston yoke 5. The dust seal band 24 to cover the top of the slit 6 is fitted in a groove 30 on each side of the slit 6 at the top of the cylinder proper 1. The dust sealing band 24 stretches to each end cover 20 through a space provided in the driven table 4 in which the dust seal band 24 contacts a rotatable roller 31. Sliders 32 on opposite ends of the driven table 4 reduce the contact resistance with the driven table 4.

The driven table 4 having a pair of guide members 34 guided by a pair of guides 33 on the cylinder proper 1 is reciprocatably mounted over the top surface of the cylinder proper 1.

As shown in FIGS. 1 and 4, the driven table 4 and the piston yoke 5 are connected by means of a coupler 35 fastened on top of the piston yoke 5. In a recess 36 provided in the driven table 4, the coupler 35 is tightly fitted in the direction of the stroke of the piston 3 to permit no relative motion in that direction. In the vertical and horizontal directions perpendicular to the direction of piston stroke, however, some clearance is left to allow the freedom of movement to the coupler 35. The roller 31 is rotatably held in the coupler 35.

Even when some horizontal or vertical external force perpendicular to the direction of piston stroke works on the driven table 4, therefore, no such force is directly transmitted to the piston yoke 5. Therefore, the piston yoke 5 is always kept out of contact with the inner surface of the slit 6.

In the rodless cylinder described above, hydraulic fluid supplied to one of the pressure chambers on both sides of the piston 3 drives the piston 3 and, at the same time, the driven table 4 on top of the cylinder proper 1.

The sealing belt 8 prevents fluid leakage through the slit 6. Even when hydraulic liquid leaks through a gap between the sealing lip 11 and the wall of the cylinder bore 2 due to the deformation of the seal lip 11 or other causes, the seal projection 12 whose edge comes in contact with the inner wall of the slit in the cylinder proper 1 near the edge of the sealing lip 11 stops the leakage there.

The hydraulic fluid leaked into the space 13 between the sealing lip 11 and the seal projection 12 tends to flow therethrough in the direction of the stroke of the piston in the cylinder proper 1. However, the cross-sectional area of the space 13 becomes so small at the end covers 20 at both ends of the cylinder proper 1 that the leakage through the end cover 20 can be readily prevented by the elastic sealing members 23 sealing the ends of the cylinder bore 2, without providing other special sealing means.

This not only prevents the leakage of hydraulic fluid beyond the sealing lip 11 but also permits designing the edge of the sealing lip with greater design freedom without paying much attention to the prevention of fluid leakage.

What is claimed is:

1. A rodless cylinder, comprising:

a cylinder having a bore with a slit formed therein which extends along a length dimension of the bore, a piston hydraulically reciprocated through the cylinder bore;

a driven table directly connected to the piston for reciprocating over the cylinder, and a piston yoke which interconnects the piston and driven table through the slit extending along the cylinder bore;

a sealing belt for sealing the slit in the cylinder with the exception of an area in which the piston yoke moves wherein the sealing belt includes:

an arched inner wall which comprises a continuation of a wall portion of the cylinder bore;

a sealing lip provided at each edge of the sealing belt for contacting with an outwardly inclined surface of the cylinder on each side of the slit;

a first sealing projection which projects from the sealing lip and is provided near the edge of the sealing lip for sealing a space defined between the sealing lip, the inclined surface of the cylinder and the first sealing projection, wherein an edge of the first sealing projection projects toward and contacts with the inclined surface when hydraulic pressure is supplied to the cylinder bore; and a second sealing projection which contacts with a sealing seat located on the inner wall of the slit when the hydraulic pressure is supplied to the cylinder bore.

2. The cylinder according to claim 1, wherein the sealing belt has a pair of guides which engage with inner surfaces of the slit.

3. The cylinder according to claim 1, which comprises an end cover fastened to each end of the cylinder, the end cover having a projection which fits in the cylinder bore, an elastic sealing material provided around the projection for hermetically sealing the end of the cylinder bore, wherein the end of the space between the sealing lip and the projection near the edge thereof is closed by a part of the sealing belt which is pressed close to the edge of the sealing lip against the inclined surface of the cylinder on each side of the slit.

* * * * *